United States Patent [19]

Engel

[11] Patent Number: 4,775,922

[45] Date of Patent: Oct. 4, 1988

[54] LAMP SYSTEM

[75] Inventor: Hartmut S. Engel, Freiberg am Neckar, Fed. Rep. of Germany

[73] Assignee: Brendel & Loewig Leuchtengesellschaft GmbH & Co. KG, Berlin, Fed. Rep. of Germany; a part interest

[21] Appl. No.: 35,483

[22] Filed: Apr. 7, 1987

[30] Foreign Application Priority Data

Apr. 7, 1986 [DE] Fed. Rep. of Germany ..... 3611594

[51] Int. Cl.[4] ..... F21S 3/00

[52] U.S. Cl. ..... 362/217; 362/263; 362/414; D26/93

[58] Field of Search ..... 362/217, 260, 263, 414, 362/431, 432; D26/93, 110, 111, 112

[56] References Cited

U.S. PATENT DOCUMENTS

| | | | |
|---|---|---|---|
| 1,648,125 | 11/1927 | Horne | 362/414 |
| 4,229,780 | 10/1980 | Nelson | 362/218 |
| 4,449,169 | 5/1984 | Warshawsky | 362/414 |
| 4,525,773 | 6/1985 | Hesse et al. | 362/414 |
| 4,527,225 | 7/1985 | Hartman | 362/414 |
| 4,562,520 | 12/1985 | Chapman | 362/414 |

FOREIGN PATENT DOCUMENTS

| | | | |
|---|---|---|---|
| 470544 | 4/1952 | Italy | 362/413 |
| 897105 | 5/1962 | United Kingdom | 362/431 |

OTHER PUBLICATIONS

Abitare Magazine, No. 176, Jul./Aug. 1979, Lamps Designed by Gecchelin, p. 5.

*Primary Examiner*—Charles J. Myhre
*Assistant Examiner*—David A. Okonsky

[57] ABSTRACT

A lamp system is described of particularly graceful construction which operates with a boom consisting of flexible tube section. This arrangement makes the lamp system easy to package and simple to transport despite the large dimensions of the assembled lamp. The flexible tube sections are capable of being connected together mechanically and electrically via plug connections and can also either be directly connected to the particular lamp head or connected thereto via flexible electrical cables.

17 Claims, 6 Drawing Sheets

LAMP SYSTEM

Figure 1:
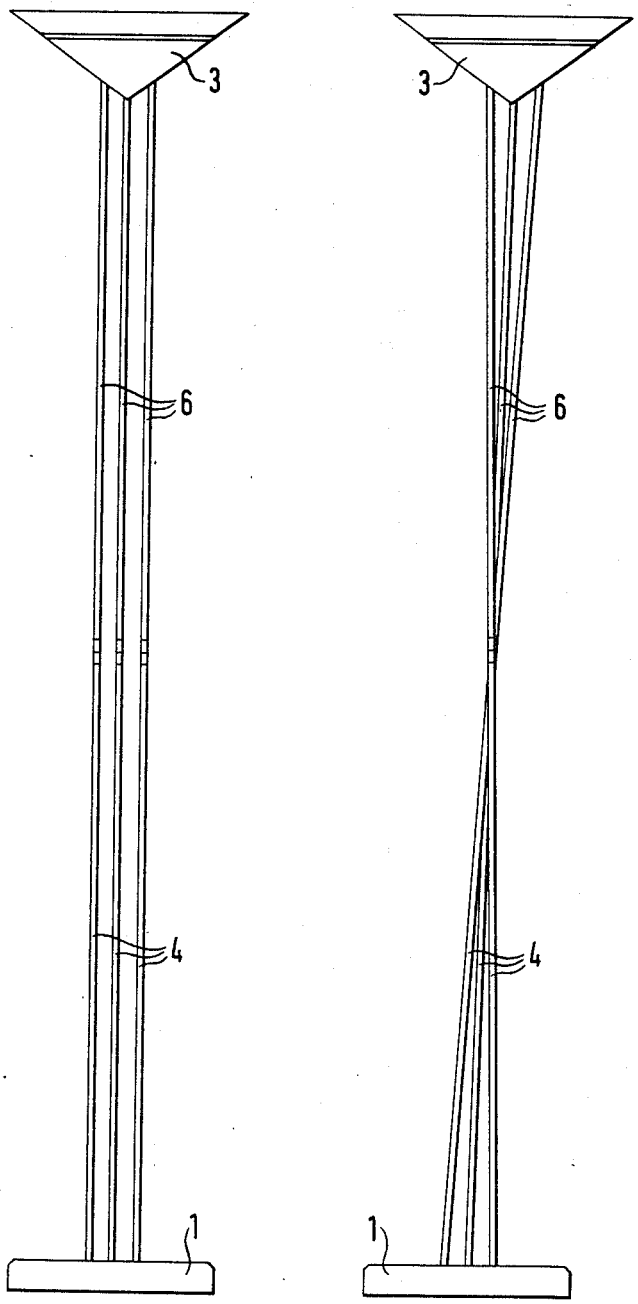

The invention relates to a lamp system consisting of a base part formed as a standing or wall mounting unit, a multiple part boom and at least one lamp head.

The object underlying the invention is to make a lamp system of this kind as variable as possible, both with regard to the overall construction and also to the lighting which can be achieved, while ensuring an overall construction which is always graceful and which makes large overhangs possible. Furthermore, the lamp system should be capable of being packaged compactly thus ensuring easy cost-effective storage and transport.

This object is satisfied in accordance with the invention essentially in that the boom consists of flexible tube sections which either form a low voltage electrical conductor or accommodate a mains voltage conductor, in that the tube sections are capable of being mechanically and electrically coupled together via single pole plug connections, and with at least said base part via plugged and screwed connections; and in that the free ends of the coupled tube sections are in turn mechanically and electrically connected with the respective lamp head either directly via plug connections or indirectly via flexible electrical leads.

The mechanical and electrical plug connections or plug and screw connections can be realised using tubes with a diameter of 8 mm, with the length of the individual tube sections not being critical, since the individual sections meet flush with one another at the connection points, with these abutment points thus being practically invisible. As a result of the ability of being able to plug the individual components of the lamp system together, neither packaging, nor storage, nor the assembly of the particular lamp system from the individual components presents any particular difficulties.

At least one tube section of each boom arm preferably has a predetermined curvature so that a whip lamp with a very large overhang can be provided by coupling such a curved tube section with a vertically disposed tube section, and optionally with a further tube section adjoining the other end of the curved tube section. Low weight lamp heads are preferably used in connection with a whip lamp of this kind. Particularly suitable are halogen lamps and high pressure lamps with a cap at one end or at both ends. These lamp heads are coupled with the ends of the boom arms, each of which is associated with one pole of the feed voltage, via flexible electrical conductors, which are in turn connected via plug connectors to both the boom arms and also the respective lamp head.

If particularly high light intensity is required a lamp head is preferably used consisting of a tube-like reflector in which a lamp is arranged with caps at both ends. The lamp is then axially elastically held by means of two plug connector parts, with the plug connector parts being releasably locked into the ends of the tube-like reflector.

In this manner the insertion and the interchanging of the lamp is facilitated, and above all the danger of breakage or damage is precluded.

The tube-like reflector has a recess in the region of the lamp which extends substantially over the full length of the lamp. The recess can admittedly be selected from the point of view of its width in accordance with the radiative behaviour which is desired in a particular case, has however preferably a width which corresponds substantially to the tube diameter.

It is particularly favourable if each plug connector part is connected with a hollow cylindrical lamp socket in which a conductor is axially displaceably mounted against the force of a compression spring. In order to ensure that as little heat as possible is transferred to the connection region and to the reflector itself the plug connector parts and lamp sockets (which preferably consist of titanium) are supported relative to the tube-like reflector via heat-resistant O-rings, whereby possibilities of circulation result which contribute to the requisite cooling.

The plug connector parts are in particular provided with radially directed connection bores and fixable into the tube-like reflector body by means of bayonet fixings.

The mechanical and electrical coupling of the tube sections takes place via coaxial plug or sleeve parts alternately inserted into the end regions of these tube sections, with the plug and sleeve parts being secured in form-locked and force-locked manner in the tube sections. It is particularly important from the point of view of electrical and mechanical safety for the electrically conducting plug and socket parts to each be surrounded by at least one coaxial plastic sleeve which extends in the axial direction beyond the plug or socket, with the sleeves of mating plugs and sockets engaging in form-locked manner within one another in the coupled state. These coaxial plastic elements also make it possible for the end faces of the tubes to abut against one another in the coupling region because the required strength of the connection is ensured by the various coaxially interengaging metallic plug and socket parts, in conjunction with the plastic parts which surround them and engage within one another in form-locked manner.

Further advantageous embodiments of the invention are set forth in the subordinate claims.

Figure 2:
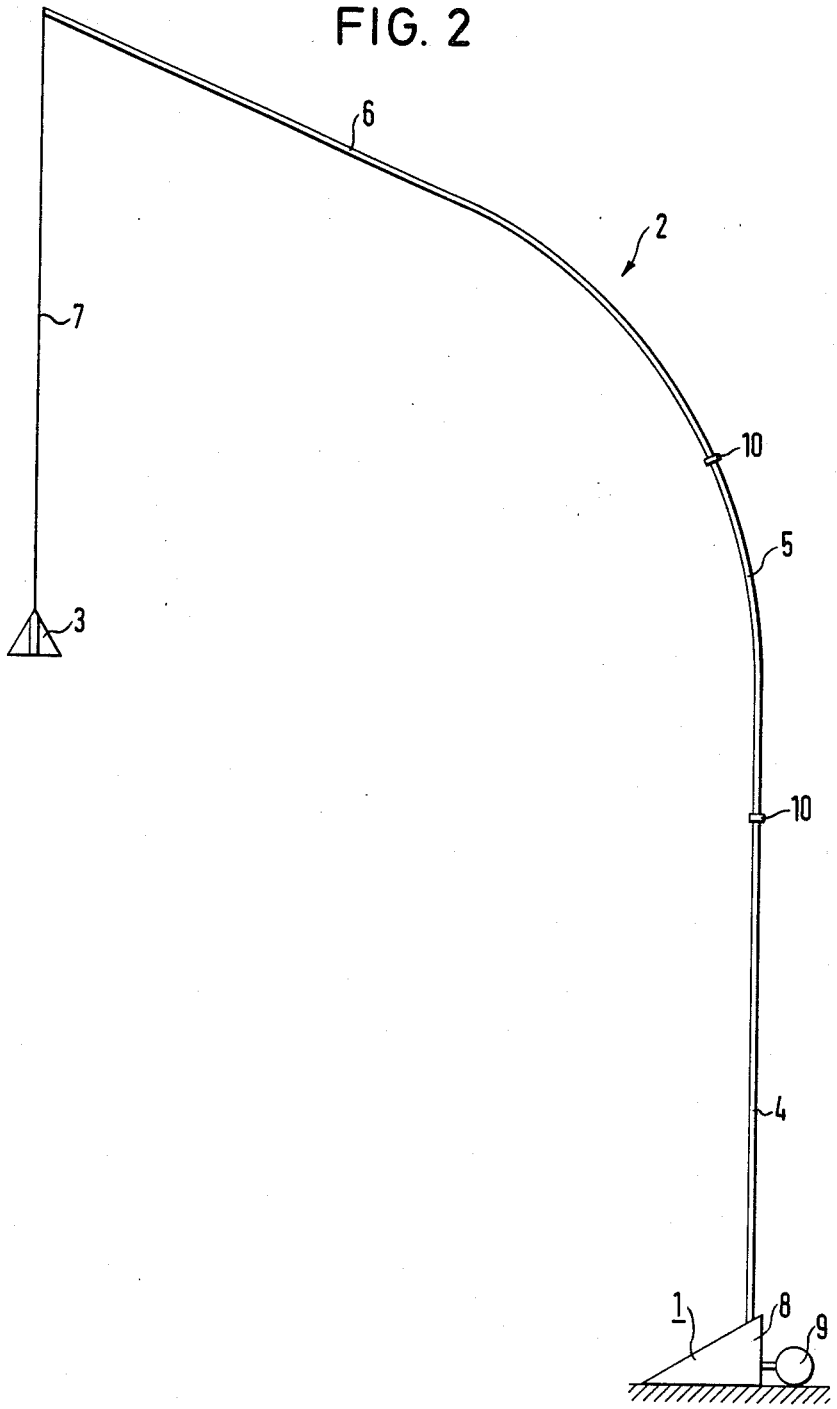
Figure 3:
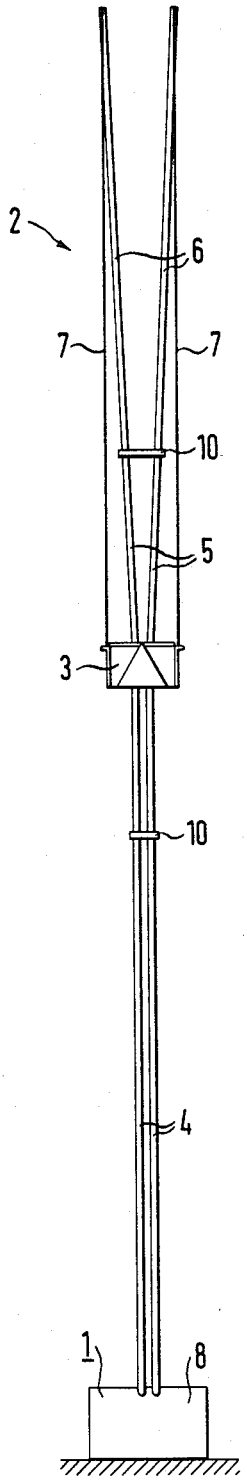
Figure 4:
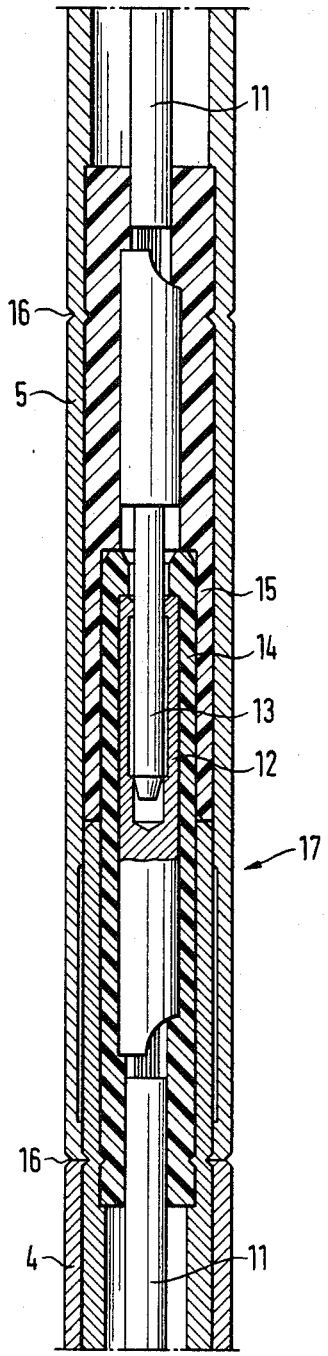
Figure 5:
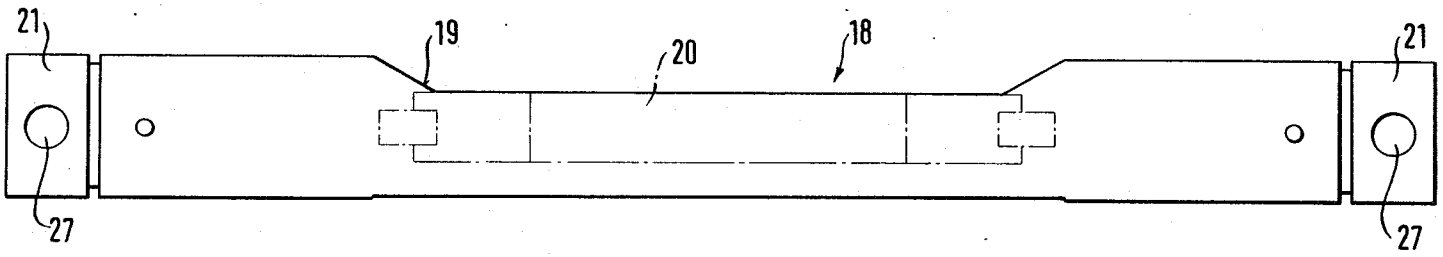
Figure 6:
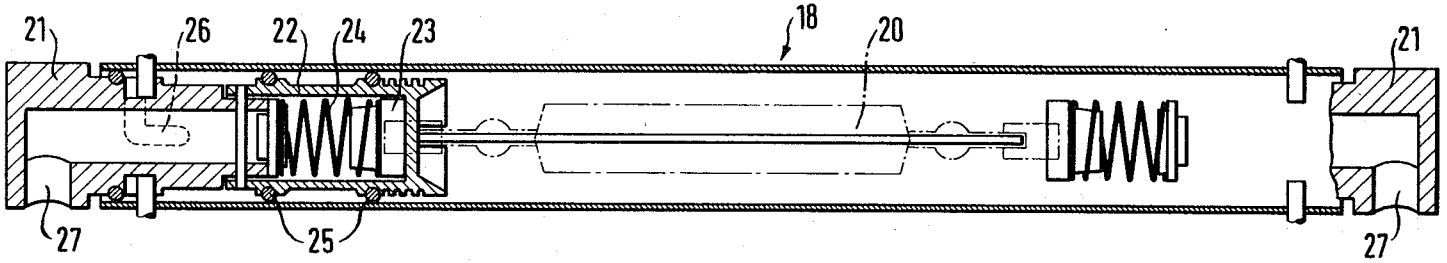
Figure 7:
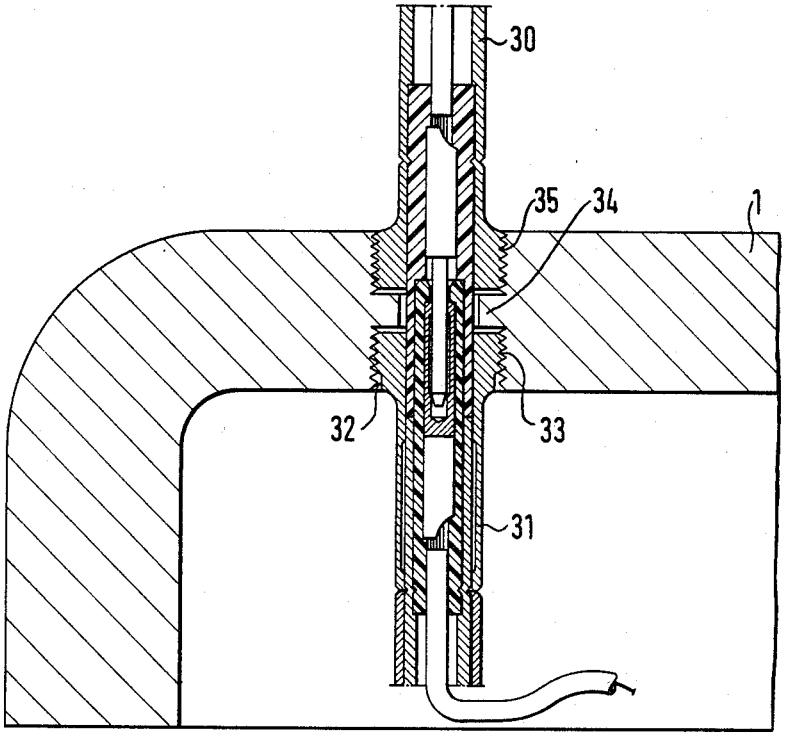

Embodiments of the invention will now be explained in more detail with reference to the drawings, which show:

FIG. 1 a schematic representation of a standing lamp which is built up in accordance with the lamp system of the invention and shown in two possible positions, FIG. 2 a sideview of a whip lamp constructed in accordance with the invention, FIG. 3 a front view of the whip lamp of FIG. 2, FIG. 4 a schematic partly sectioned representation of the mechanical and electrical connection between two pipe sections, FIG. 5 a schematic sideview of an embodiment of a lamp head for the lamp system of the invention, FIG. 6 a schematic partly sectioned representation of the arrangement of FIG. 5 and FIG. 7 a detail showing a plugged and screwed connection.

As seen in FIG. 1 a standing lamp built up in accordance with the lamp system of the invention includes a base part 1 constructed as a pedestal with which three rods are connected. These rods are put together from individual tube sections 4, 6 and preferably disposed in accordance with a triangular arrangement. The individual rod sections 4, 6 are mechanically and electrically connected together via plug couplings and the lamp head 3 is also secured via plug couplings. The rods are preferably screwed into the base part with electrical plug couplings preferably likewise being provided which are coupled with the electric feedline on screwing in the corresponding tube sections. This type of connection will be explained later in more detail with reference to FIG. 7.

The standing lamp illustrated here is especially constructed to radiate vertically upwardly and can be equipped with bulbs with a cap at one end or at both ends.

As a result of using elastic hollow rods the entire O structure is flexible and imparts an extremely graceful overall impression. This overall impression can also be modified, as shown in FIG. 1, by twisting the three rods as an assembly. The lamp remains after twisting in the illustrated position, it can however be returned to the embodiment shown at the left hand side of FIG. 1 at any time.

FIG. 2 shows a particularly characteristic embodiment of a lamp of the invention in the form of a whip lamp. For this purpose two straightline tube sections 4, 6 are coupled with a tube section 5 of curved construction so that a flexible boom is created which is connected at the floor end to a stable base part 1 and at its free end with a lamp head 3 via electrical conductors in cable form.

The base part 1 consists in this embodiment of a hollow part 8 which accommodates the electrical components, for example a transformer, and a solid part 9 which is preferably adjustable relative to the hollow part 8 in order to take account of the stability requirements in any particular case. Stability can be produced by adjusting the position of the counterweight 9 relative to the base 8 so as to counteract the tilting movement generated at the base 8 by the boom and lamp head assembly.

The front view of FIG. 3 shows in turn the graceful structure of the whip lamp of the invention. The two tube sections 4 which are arranged alongside one another are preferably mutually fixed in the region of the transition to the curved section by means of a clamp-like spacer 10, and a further such clamp-like spacer 10 is provided in the region of the curved tube section 6. The angle of divergence of the tubes which lie alongside one another in the whip region is fixed by the choice of this clamp-like distance holder. This angle is preferably so selected that on taking account of the connection points the electrical cable 7 extends vertically and parallel to each other from the lamp head 3 to the free end of the tube section 6.

FIG. 4 shows the mechanical and electrical coupling of the tube sections 4, 5. This plug coupling is characterised by its very compact but nevertheless mechanically rigid construction and it connects the two conductor sections 11 via a sleeve/plug coupling 12, 13 (i.e. a mating male pin and female sleeve coupling). It is important that plastic sleeve parts 14, 15 are provided between these two elements, which engage within one another in form-locked manner, and the tube wall. The plastic sleeve parts 14, 15 also engage in form-locked manner within one another so that a solid rod consisting of several concentricall interengaging elements results in the coupling region. In the axial direction the associated plastic sleeve parts 14, 15 project in both cases beyond the sleeve part 12 and the plug part 3. The fixing of the plug and socket elements within the tubular sections 4, 5 preferably takes place via peripheral clamping ribs or beads 16.

FIG. 5 shows a lamp head which can be used in acordance with the lamp system of the invention for lamps with caps at both ends, in particular halogen or high pressure lamps. Such lamps must be so held and mounted that no dangers can arise from the heat development which occurs. Moreover, it is of importance that such lamps can be inserted without problem into their sockets, so that the danger of damage can be avoided.

In the embodiment of FIG. 5 the lamp head consists of a tube-like reflector part 18 which is provided with a cut-out 19, the width of which preferably corresponds to the tube diameter. The lamp 20 is arranged in this cut-out region.

This lamp 20 is axially resiliently held by means of two plug connector parts 21.

A particularly preferred embodiment of this mounting is shown in FIG. 6.

Each of the two plug connection parts 21 is inserted into a respective end of the tube 18 and is preferably connected there with a hollow cylindrical lamp socket or holder 22 via a pin, with a conductor 23 being axially displaceably mounted in the hollow cylindrical lamp socket 22 for movement against the force of a compression spring 24. The individual elements are preferably manufactured in titanium and care is taken that as little heat as possible is transferred into the immediate connection region. It is also possible to integrate a plug connection or a plugged and screwed connection into this bore 27.

The plug connection part 21 and the lamp socket 22 are braced against the tube-like part 18 via heat-resistant O-rings 25 and cooling ribs are preferably provided in the immediate contact region on the outer surfaces of the individual parts.

FIG. 5 indeed indicates that the lamp sockets at the two ends for the lamp 20 are of identical construction, it is however only important that an axial flexible arrangement is provided at at least one end in order to make the insertion and changing of the lamp or bulb 20 as simple as possible.

For this purpose the plug connection part 21 is releasably locked to the tube 18, and indeed preferably by a bayonet connection 26. This design provides an ideal thermal barrier relative to the connection lines and makes it possible to change the particular lamp with caps at both ends without difficulty.

The embodiment of the lamp head shown in FIGS. 5 and 6 can be particularly well combined with the fine elemental structure of the various possible embodiments of lamps in accordance with the invention, with the low weight having particular advantages, especially with whip lamps of large overhang.

The use of the lamp head of FIGS. 5 and 6 is however not restricted to the above described lamp systems.

Finally, FIG. 7 shows a sectioned view of the plugged and screwed connection between the lower end of one tube 30 of the tube section 5 and the base. It will be noted that this connection embodies a cartridge as shown in FIG. 4 with one half of the cartridge being secured in the tube 30 and the other half being secured in the base 1. The cartridge itself will not be described in more detail It will be understood that the mating ends of the two halves of the cartridge can be partly engaged with one another and that on screwing the tube 30 into the base 1 the two halves of the cartridge move into full engagement. The rotationally symmetrical design of the coaxial cartridge makes it possible for the cartridge halves to be rotated relative to one another through any desired number of turns without twisting the associated wires. In the full engaged state of the screwed and plugged connection the mechanical engagement between the tube 30 and base 1 fully protects the cartridge against bending loads. It will be noted that the bottom half of the cartridge is inserted into a stub tube 31 with a thread 32 at its upper end. On assembly the stub tube 31, with the bottom half of the cartridge secured therein is screwed into the lower screw thread 33 in the base into contact with the ring shoulder 34. The tube 30 is then screwed into the top screw thread 35, into contact with the top surface of the shoulder 34.

I claim:

1. A lamp comprising: a base part; a lamp head; and a boom having first and second ends extending between said base part and said lamp head, said lamp head being carried by said boom fro said base unit; said boom comprising at last three flexible straightline tube elements which are symmetrically spaced relative to one another and are movable from a parllel position into a stable twisted position; each tube element comprising at least first and second tube sections, coupling means capable of connecting together said tube sections respectively, end to end, each coupling means comprising a coaxial single pole plug and socket connection, and defining a mechanical and electrical connection between coupled tube sections; and screw connections at said first end of said boom for each tube element for connecting said boom to said base part.

2. A lamp in accordance with claim 1, wherein the lamp head is an upwardly directed projector lamp head.

3. A lamp in accordance with claim 2, wherein said upwardly directed projector lamp head comprises a slot light.

4. A lamp comprising: a base part; at least one lamp head; and a boom having first and second ends and extending between said base part and said lamp head; said boom comprising a plurality of boom elements disposed alongside one another; each boom element comprising at least first and second tube sections, coupling means capable of coupling together end to end said tube sections, each coupling means comprising a coaxial single pole plug and socket connection, and defining a mechanical and electrical connection between said first and second tube sections; screw connections at said first end of said boom for each boom element for connecting said boom to said base part, each screw connection including a coaxially disposed single pole plug and socket connection for electrical connection of said boom to a power supply leading entering said lamp through said base part; and plug connection means at said second end of said boom for connecting said boom to said at least one lamp head.

5. A lamp comprising: a base part; at least one lamp head; and a boom having first and second ends and extending between said base part and said lamp head; said boom comprising a plurality of boom elements disposed alongside one another; each boom element comprising at least first and second tube sections, coupling means capable of coupling together said tube sections respectiely end to end, each coupling means comprising a coaxial single pole plug and socket connection, and defining a mechanical and electrical connection between said first and second tube sections; screw connections at said first end of said boom for each boom element for connecting said boom to said base part, each screw connection including a coaxially disposed single pole plug and socket connection for electrical connection of said boom to a power supply lead entering said lamp through said base part; and flexible electrical leads suspending said lamp head from said second end of said boom.

6. A lamp in accordance with claim 4, wherein each first tube section is straight and vertically disposed, and wherein each second tube section has a fixed preset curvature.

7. A lamp in accordance with claim 5, wherein each first tube section is straight and vertically disposed, and wherein each second tube section has a fixed preset curvature.

8. A lamp in accordance with claim 6, wherein said base part comprises a hollow part for accommodating electrical components and a solid part mounted externally of said hollow part, said solid part forming a counter-weight for balancing said lamp.

9. A lamp in accordance with claim 7, wherein said base part comprises a hollow part for accommodating electrical components and a solid part mounted externally of said hollow part, said solid part forming a counter-weight for balancing said lamp.

10. A lamp in accordance with claim 4, comprising clamp-like spacers between said tube elements for spacing said tube elements one from the other and arranged adjacent said coupling means for coupling said tube sections of said tube elements together.

11. A lamp in accordance with claim 5, comprising clamp-like spacers between said tube elements for spacing said tube elements one from the other and arranged adjcent said coupling means for coupling said tube sections of said tube elements together.

12. A lamp in accordance with claim 4, wherein each coaxial single pole plug and socket connection for connecting said tube sections end to end comprises a plug part having a conductor pin disposed within an insulating sleeve and retained withn an end of one tube section by indentation of a wall part of said tube section, and a socket part including a metallic socket disposed within an insulating sleeve and retained in an end of a mating tube section by indentation of a wall part thereof, and wherein said insulating sleeve of said plug part and said insulating sleeve of said socket part engage within one another when said tube sections are coupled together by said coupling means.

13. A lamp in accordance with cliam 3, wherein each said coaxial single pole plug and socket connection for connecting tube sections end to end comprises a plug part having a conductor pin disposed within an insulating sleeve and retained within an end of one tube section by indentation of a wall part of said tube section and a socket part including a metallic socket disposed within an insulating sleeve and retained in an end of a mating tube section by indentation of a wall part thereof, and wherein said insulating sleeve of said plug part and said insulating sleeve socket part engage within one another when said tube sections are coupled together by said coupling means.

14. A lamp head comprising a tubular reflector havign a tubular wall, first and second ends and a cut-out in said tubular wall between said first and second ends, said tubular reflector being adapted to accommodate a double ended light bulb having caps at both ends; respective first and second connector parts insertable into said first and second ends and connectable to said tubular reflector by respective bayonet connections; first and second substantially cylindrical lamp holders respectively mountable on said first and second connector parts; each lamp holder having a diameter smaller than an internal diameter of said tubular reflector, thereby defining an annular space between said lamp holders and said tubular reflector; at least one of said lamp holders having a hollow chamber in its interior containing a respective spring loaded contact for contacting one of said lamp caps, and the other lamp holder having a further contact for contacting the other of said lamp caps.

15. A lamp head in accordance with claim 14, comprising O-rings disposed in said annular spaces, supporting said lamp holders within said tubular reflector.

16. A lamp head in accordance with claim 4, wherein said lamp holders consist of titanium.

17. A lamp holder in accordance with claim 14, comprising a cross pin connecting each lamp holder to the associated connector part.

* * * * *